US007337844B2

(12) United States Patent
Surjaatmadja et al.

(10) Patent No.: US 7,337,844 B2
(45) Date of Patent: Mar. 4, 2008

(54) PERFORATING AND FRACTURING

(75) Inventors: Jim B. Surjaatmadja, Duncan, OK (US); Michael Harries, Gt. Yarmouth (GB)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/430,679

(22) Filed: May 9, 2006

(65) Prior Publication Data

US 2007/0261852 A1 Nov. 15, 2007

(51) Int. Cl.
*E21B 43/26* (2006.01)
*E21B 28/00* (2006.01)

(52) U.S. Cl. ..... 166/308.1; 166/177.5

(58) Field of Classification Search ..... None
See application file for complete search history.

(56) References Cited

U.S. PATENT DOCUMENTS

| | | | | |
|---|---|---|---|---|
| 2,927,638 | A * | 3/1960 | Hall, Sr. | 166/308.1 |
| 4,050,529 | A * | 9/1977 | Tagirov et al. | 175/424 |
| 4,917,349 | A | 4/1990 | Surjaatmadja et al. | |
| 4,990,076 | A | 2/1991 | Lynch et al. | |
| 5,125,582 | A | 6/1992 | Surjaatmadja et al. | |
| 5,226,445 | A | 7/1993 | Surjaatmadja | |
| 5,361,856 | A | 11/1994 | Surjaatmadja et al. | |
| 5,366,015 | A | 11/1994 | Surjaatmadja et al. | |
| 5,494,103 | A | 2/1996 | Surjaatmadja | |
| 5,499,678 | A | 3/1996 | Surjaatmadja et al. | |
| 5,533,571 | A | 7/1996 | Surjaatmadja et al. | |
| 5,560,427 | A * | 10/1996 | Jones | 166/280.1 |
| 5,577,559 | A | 11/1996 | Voll et al. | |
| 5,765,642 | A | 6/1998 | Surjaatmadja | |
| 6,286,599 | B1 | 9/2001 | Surjaatmadja et al. | |
| 6,286,600 | B1 | 9/2001 | Hall et al. | |
| 6,394,184 | B2 * | 5/2002 | Tolman et al. | 166/281 |
| 6,422,317 | B1 | 7/2002 | Williamson, Jr. | |
| 6,662,874 | B2 * | 12/2003 | Surjaatmadja et al. | 166/309 |
| 6,932,156 | B2 | 8/2005 | Bayne et al. | |
| 6,938,690 | B2 | 9/2005 | Surjaatmadja et al. | |
| 2005/0061508 | A1 | 3/2005 | Surjaatmadja | |
| 2005/0061520 | A1 | 3/2005 | Surjaatmadja | |
| 2005/0121196 | A1 | 6/2005 | East, Jr. et al. | |
| 2005/0183741 | A1 | 8/2005 | Surjaatmadja et al. | |
| 2005/0211439 | A1 | 9/2005 | Willett et al. | |
| 2005/0224231 | A1 | 10/2005 | Surjaatmadja | |
| 2005/0224232 | A1 | 10/2005 | Surjaatmadja | |
| 2005/0230107 | A1 | 10/2005 | McDaniel et al. | |
| 2005/0269075 | A1 | 12/2005 | Surjaatmadja et al. | |
| 2005/0274522 | A1 | 12/2005 | Surjaatmadja et al. | |
| 2005/0279501 | A1 | 12/2005 | Surjaatmadja et al. | |
| 2005/0281133 | A1 | 12/2005 | Surjaatmadja | |
| 2006/0022073 | A1 | 2/2006 | King et al. | |

* cited by examiner

*Primary Examiner*—Jennifer H. Gay
*Assistant Examiner*—Angela DiTrani
(74) *Attorney, Agent, or Firm*—John W. Wustenberg; Fish & Richardson, P.C.

(57) ABSTRACT

In a system and method of fracturing a subterranean formation, fluid for perforating is received in a downhole tool through a tubing string, the downhole tool residing in a wellbore. A wall of the wellbore is perforated proximate the downhole tool. A fluid for fracturing is received in the downhole tool through the tubing string. The subterranean formation proximate the downhole tool is fractured. The operations of receiving a fluid for perforating, perforating, receiving a fluid for fracturing, and fracturing are performed while keeping at least a portion of the downhole tool in the wellbore.

18 Claims, 12 Drawing Sheets

PERFORATING AND FRACTURING

This description relates to well completion operations and, more particularly, to perforating and fracturing operations.

Subterranean formations are regularly explored and exploited for resources through various drilling and extraction techniques. When trying to recover hydrocarbon resources from a subterranean formation, a well is typically drilled in the ground and lined with a casing. The casing is then perforated at certain points and the surrounding subterranean formation is fractured to allow the hydrocarbons to flow from the formation into the well.

Fracturing a subterranean formation may be accomplished by a variety of techniques. For example, a fracturing fluid including a proppant (e.g. sand) may be pumped from the surface, down an annulus between a working string and the casing, and into the formation through the perforations. Pumping the fracturing fluid substantial distances through the annulus causes excessive wear on the wellhead, casing and other components of the well, because the proppant in the fracturing fluid is abrasive.

SUMMARY

The present disclosure is generally directed to systems and methods for perforating and/or fracturing a formation.

One aspect encompasses a method of fracturing a subterranean formation. In the method a formation fracturing fluid is received in a downhole tool in a wellbore. A first portion of the formation fracturing fluid is supplied from the downhole tool to an annulus between the downhole tool and a wall of the wellbore proximate the downhole tool. A second portion of the formation fracturing fluid is supplied to an aperture operable to direct the second portion toward the wall of the wellbore such that at least part of the first portion in the annulus flows into the subterranean formation.

In another aspect, a system for fracturing a subterranean formation includes a formation fracturing apparatus. The formation fracturing apparatus has an intake operable to receive a formation fracturing fluid while in a wellbore. A fluid distributor is operable to supply a first portion of the formation fracturing fluid to an annulus between the formation fracturing apparatus and a wall of the wellbore proximate the formation fracturing apparatus and to supply a second portion of the formation fracturing fluid to an aperture of the system. The aperture is operable to direct the second portion toward the wall of the wellbore such that the second portion causes at least part of the first portion in the annulus to flow into the subterranean formation In another aspect, a method includes receiving a fluid for perforating in a downhole tool through a tubing string. A wall of the wellbore is perforated with the perforating fluid proximate the downhole tool. Fracturing fluid is received in the downhole tool through the tubing string. The subterranean formation is fractured proximate downhole tool with the fracturing fluid. The operations of receiving a fluid for perforating, perforating, receiving a fluid for fracturing and fracturing operations are performed while keeping at least a portion of the downhole tool in the wellbore.

The details of one or more implementations are set forth in the accompanying drawings and the description below. Other features will be apparent from the description and drawings, and from the claims.

BRIEF DESCRIPTION OF THE DRAWINGS

FIGS. 9-12 are a schematic diagram of another example of a system for perforating and fracturing a subterranean formation, wherein FIG. 9 shows an example workstring prior to perforating a wellbore;

FIG. 10 shows an example workstring fracturing the wellbore;

FIG. 11 shows an example work string perforating the wellbore in a longitudinally spaced location from the first perforated location; and FIG. 12 shows an example completed well according to concepts described herein.

Like reference symbols in the various drawings indicate like elements.

DETAILED DESCRIPTION

Figure 1:
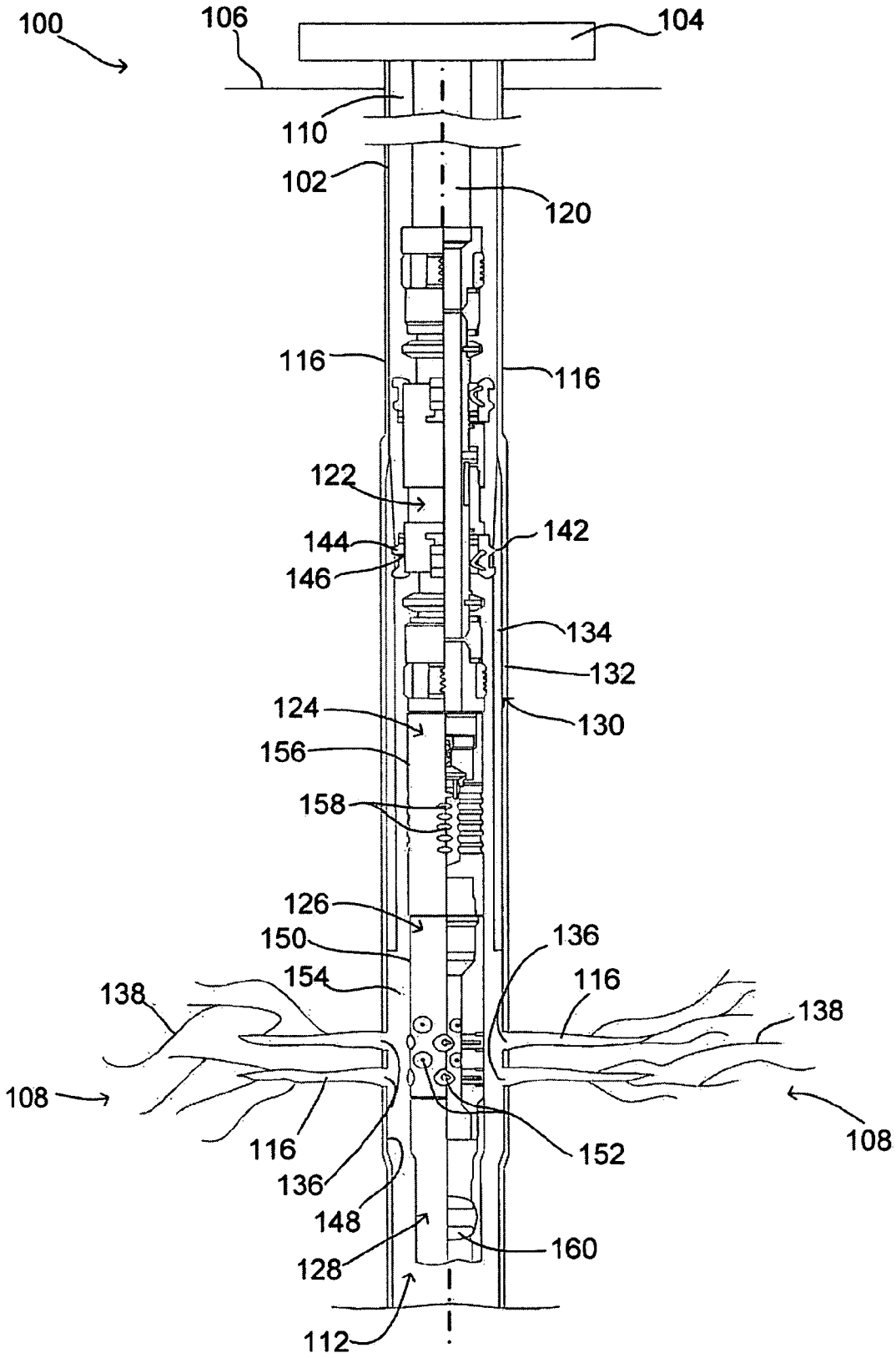
FIG. 1 is a partially-sectioned diagram illustrating one example of a system for perforating and fracturing a subterranean formation.

Referring to FIG. 1, a well having a wellhead 104 is disposed proximal to a ground surface 106 and a wellbore 110. The wellhead 104 may be coupled to a casing 102 that extends through at least a portion of the wellbore 110 from the ground surface 106 towards a production interval 108. In this embodiment the wellbore 110 extends in a substantially vertical direction toward the production interval 108. It should be understood that, in other embodiments, at least a portion of the wellbore 110 may be curved or extend in a substantially horizontal direction. The wellbore 110 may be formed by drilling into the earth 116 from the surface 106.

The casing 102 may be lowered into the well 100 after the wellbore 110 is formed in the earth 116 to create the wellbore 110. The casing 102 may be configured to abut with the adjacent earth 116. In some embodiments, the outside of the casing 102 may be jacketed by cement. A perforating and fracturing string 112 may be at least partially disposed within the wellbore 110 proximal to the production interval 108. The well 100 may have one or more production intervals 108 that may be perforated and fractured. The production intervals 108 are intervals of the earth 116 in which it is desired to produce fluids, inject fluids, or perform other operations. A production interval 108 may correspond to a single formation in the earth 116, may span multiple formations, or may encompass only a portion of a formation.

FIG. 1 depicts one illustrative embodiment of a perforating and fracturing string 112. The perforating and fracturing string 112 may include a plurality of downhole tools. In this embodiment, the perforating and fracturing string 112 includes a length of supply tubing 120, a window sleeve operating tool 122, a fluid distributor 124, a jet sub 126, and a valve 128.

In some instances, the casing 102 may include one or more window casings 130 (one shown in the embodiment of FIG. 1) proximal to where the wellbore 110 is to be perforated and fractured. The window casings 130 may, however, be omitted. The window casing 130 comprises a section of casing with an outer casing 132 and a sliding inner sleeve member 134. The sliding inner sleeve member 134 is disposed axially within the inside of the outer casing 132. In other instances, the sliding inner sleeve member 134 may alternately, or in combination with sliding axially, be configured to rotate within the outer casing 132. The sliding inner sleeve member 134 may be changed between a closed position and an open position. In the closed position the sliding inner sleeve member 134 may cover the perforations 136 or the point at which the perforations 136 may be formed in the outer casing 132. In the open position the sliding inner sleeve member 134 may leave the perforations 136, or the point at which the perforations 136 may be formed in the outer casing 132, open. In the operation of the well 100, the perforations 136 may be isolated from the rest of the well 100, i.e., closed off, by sliding the inner sleeve member 134 to the closed position to substantially seal against flow into or out of the perforations 136.

In the embodiment of FIG. 1 the window casing 130 is shown with the sliding inner sleeve member 134 in the open position. As such, the perforations 136 in the outer casing 132 are exposed (i.e., open) allowing flow into or out of the perforations 136 and fractures 138. The sliding inner sleeve member 134 has a female profile 142. The window sleeve operating tool 122 has dogs 144 with a matching male profile 146. The dogs 144 on the window sleeve operating tool 122 may be radially biased outward to selectively engage the female profile 142 on the sliding inner sleeve member 134. Engaging the female profile 142 on the sliding inner sleeve member 134 provides the window sleeve operating tool 122 with the ability to selectively engage and move the sliding inner sleeve member 134. The sliding inner sleeve member 134 may be moved from the open to the closed position, or from the closed to the open position, by actuating the dogs 144 to engage the female profile 142 and moving the perforating and fracturing string 112 axially within the wellbore 110.

The perforating and fracturing string 112 may be used to form perforations 136 in the casing 102 or outer casing 132, and thereafter fractures in the earth 116. In the absence of outer casing 132, perforations 136 may also be formed directly in the adjacent earth 116. If at least some of the perforations 136 are to be formed by the perforating and fracturing string 112, the perforating and fracturing string 112 may include a tool to form the perforations 136. The perforating tool may comprise a hydraulic perforating tool a bullet or shaped charge perforating tool, or other perforating tool. In the embodiment of FIG. 1, the perforating tool comprises a hydraulic perforating tool, jet sub 126. The perforations 136 may be hydraulically formed in the outer casing 132 and the adjacent earth 116 by the jet sub 126. The jet sub 126 is a device configured to direct high pressure perforating fluid radially outward to perforate 136 (i.e. form apertures in) the wall 148 of the wellbore 110, including either the casing 102, the outer casing 132 of the window casing 130, the earth 116 or other component of the well 100. To this end, the jet sub 126 includes a body 150 adapted to couple to the fluid distributor 124 and the valve 128. The body 150 of the jet sub 126 has one or more radially oriented ports or jet apertures 152 spaced about its circumference. The jet apertures 152 operate to direct high pressure perforating fluid received in the jet sub 126 to form perforations 136. In this embodiment, the perforating fluid is communicated to the jet sub 126 from the surface 106 through the interior of the supply tubing 120, the interior of the sleeve operating tool 122, and the interior of the fluid distributor 124.

Still referring to FIG. 1, with perforations 136 formed and the sliding inner sleeve member 134 in the open position, the earth 116 surrounding the wellbore 110 may be fractured by introducing high pressure fracturing fluid into the wellbore 110. The fracturing fluid flows through the perforations 136 and into the earth 116. The fracturing fluid may be communicated to the vicinity of the perforations 136 in numerous ways. For example, the fracturing fluid may be communicated from the surface 106 to the vicinity of the perforations 136 entirely through the annulus 154 between the wall of the wellbore 110 (e.g., casing 102) and the perforating and fracturing string 112. In other instances, as in this embodiment, the fracturing fluid may be communicated from the surface 106 to the vicinity of the perforations 136 wholly through the interior of the perforating and fracturing string 112.

The fluid distributor 124 shown in FIG. 1 is a device that may be switchably configured to direct the flow paths of high pressure fluids within the perforating and fracturing string. The fluid distributor 124 includes a body 156 adapted to couple both to the sleeve operating tool 122 and to the jet sub 126. The fluid distributor 124 may be selectively configured to only communicate high pressure perforating fluid from the supply tubing 120 to the jet sub 126, or to concurrently or simultaneously communicate high pressure fracturing fluid to one or more radially oriented fracturing apertures 158 spaced about the circumference of the fluid distributor 124 as well as to the jet sub 126.

During the perforating operation, the fluid distributor 124 operates to flow perforating fluid received from the surface 106 via the interior of the perforating and fracturing string 116 only to the jet sub 126. During the fracturing operation the fluid distributor 124 operates to concurrently or simultaneously release fracturing fluid received from the surface 106 via the interior of the perforating and fracturing string 116 through the fracturing apertures 158 as well as to the jet sub 126. In the fracturing operation, the fluid distributor 124 supplies the majority of the fracturing fluid through the fracturing apertures 158 into the annulus 154. The rest of the flow of fracturing fluid flows out of the jet apertures 152 in the jet sub 126. The flow out of the jet apertures 152 in the jet sub 126, while at a lower pressure than during the perforating operation, is sufficient enough to create a low pressure zone (i.e., pressure gradient) in the perforations 136. The low pressure zone draws or entrains the fracturing fluid from the annulus 154 into the perforations 136. The combined flow of fracturing fluid from the annulus 154 (via the fracturing apertures 158) and from the jet sub 126 into the perforations 136 causes the formation of the fractures 138.

Because the fluid distributor 124 is near (and in some instances, like FIG. 1, adjacent to) the jet sub 126, the fracturing fluid is released into the annulus 154 near the perforations 136. The fracturing fluid need not be communicated from the surface 106 or other substantially distance through the annulus 154 to the perforations 136.

The valve 128 at the bottom of the string is shown in the closed position, as such, any fluid flow that flows down the interior of the perforating and fracturing string 112 flows either out the jet apertures 152 in the jet sub 126 or the fracturing apertures 158 in the fluid distributor 124 depending upon the configuration of the fluid distributor 124. In this embodiment, the valve 128 comprises a ball valve 160. In alternate embodiments, the valve 128 may comprise a different type of valve mechanism. In some instances, the valve 128 may be opened to allow flow through to other tools in the perforating and fracturing string 112, for example, another perforating or fracturing tool below the valve 128 at the bottom of the perforating and fracturing string 112. In other embodiments, the valve 128 may be omitted and an end of the jet sub 126 may be blind or the perforating and fracturing string 112 may be otherwise blind.

The illustrative embodiment in FIG. 1 shows the perforating and fracturing string 112 located proximal to a single production interval 108. If it is desired to perforate and fracture multiple production intervals 108, the perforating and fracturing string 112 may be run into the furthest location (i.e., production interval 108) in the wellbore 110 at which perforations 136 and fractures 138 are to be formed. The location is then perforated and fractured. If the location coincides with a window casing 130, the sleeve operating tool 122 is operated to engage the sleeve member 134 and move the sleeve member 134 to the open position prior to perforating and fracturing. After perforating and fracturing at the location, the sleeve member 134 may optionally be moved to the closed position if it is desired to isolate the location. The perforating and fracturing string 112 is then moved to the next location closest to the surface 106. The location is perforated and fractured. The perforating and fracturing string 112 is once again moved to the next location closest to the surface 106, and the perforating and fracturing operation is repeated. The perforating and fracturing operation may be repeated until perforations 136 and fractures 138 have been formed at each location desired within the wellbore 110. The perforating and fracturing string 112 is then withdrawn from the wellbore 110. In other instances, the desired locations can be perforated and fractured serially beginning at the location closest to the surface 106 and working toward the end of the wellbore 110, or the desired locations can be perforated and fractured in another order or in no order.

Figure 2:
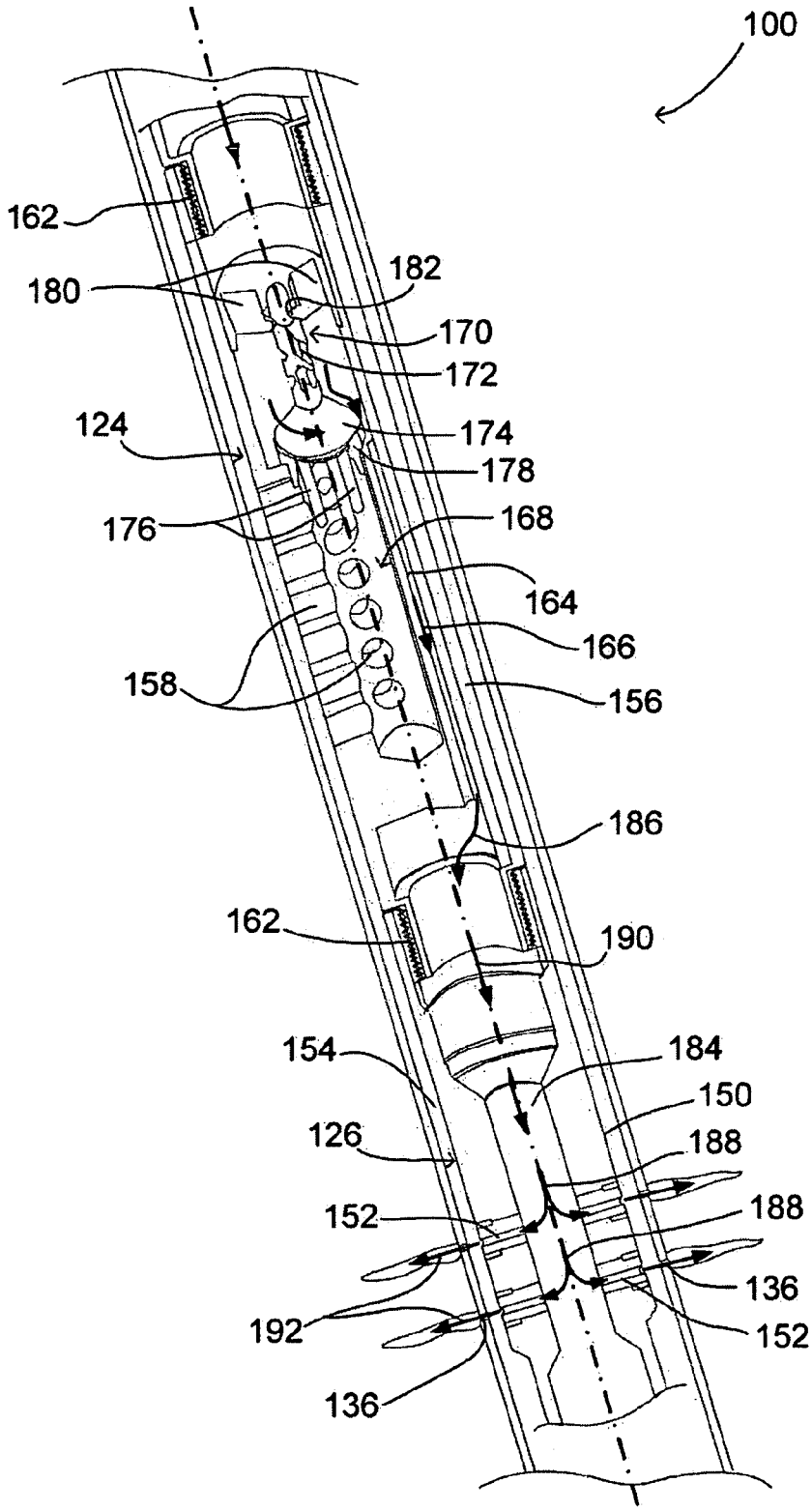
FIG. 2 is a partially-sectioned detail view of a portion of the system of FIG. 1 in one mode of operation.

Referring to FIG. 2, a section of the well 100 and a section of the perforating and fracturing string 112 that includes the fluid distributor 124 and the jet sub 126 are shown. Both the fluid distributor 124 and the jet sub 126 have tubular bodies 156 and 150. The fluid distributor 124 and the jet sub 126 are joined to one another and to the other tools in the perforating and fracturing string 112, for example by threaded pin and box couplings 162 or in another manner.

The fluid distributor 124 has an axial flow passage 164 in the interior of the tubular body 156. The axial flow passage 164 is always open, as noted by flow arrow 166. The axial flow passage 164 allows for the constant communication of fluid from the supply tubing 120 (via flow arrows 202 and 204) to flow (flow arrow 166) to the jet sub 126. Additionally, the fluid distributor 124 has another interior flow volume 168. The flow volume 168 supplies fluid to a plurality of large radial passages, fracturing apertures 158. The fracturing apertures 158 are located radially along the side of the fluid distributor 124. The fracturing apertures 158 allow the fluid supplied by the flow volume 168 to communicate radially outward into the wellbore 110. The fluid distributor 124 has a valve mechanism, control member 170, in its interior that controls the flow of fluid into the flow volume 168. The control member 170 is located above the flow volume 168. The control member 170 includes a poppet 174 and a cam slot assembly 172. The poppet 174 of the control member 170 substantially seals against a seat 178 when in the closed position, i.e., fluid flow into the flow volume 168 is blocked. The poppet 174 of the control member 170 is displaced from the seat 178 to allow flow therebetween when in the open position, i.e., fluid may flow into the flow volume 168 and out fracturing apertures 158.

The fluid distributor 124 has guides located at the top and at the bottom of the fluid distributor 124. The top guide is comprised of one or more radially oriented fins 180 that define a circular hole in the middle of the inside of the fluid distributor 124. The fins 180 each have a cam pin 182 that rides in the cam slot assembly 172 on the top part of the control member 170. The cam slot assembly 172 and the cam pin 182 control operation of the control member 170 in changing between the open and closed positions. The cam slot assembly 172 receives the cam pin 182 and guides the cam pin 182 through a plurality of slot positions corresponding to the open and closed position (i.e. the poppet 174 substantially sealing with the seat 178 or allowing flow between the poppet 174 and the seat 178). The relative position of the cam slot assembly 172 to the cam pin 182 is controlled by changing the direction of the fluid flow inside the perforating and fracturing string 112. Reversing the flow of the fluid momentarily to flow toward the surface brings the control member 170 up and slips the cam pin 182 into the next slot position of the cam slot assembly 172. Subsequently, flow in the downward direction inside the perforating and fracturing string 112 and the cam slot assembly 172 seats the cam pin 182 into that slot position. In one instance, the slot positions can alternate between an open slot position and a closed slot position. Accordingly, the cycle of reversing the fluid flow and then flowing the fluid flow forward changes the position of the control member 170 from the open to the closed position or from the closed position to open the open position. The order of open slot positions and closed slot positions on the cam slot assembly 172 can be different to achieve different operation.

The bottom guide is comprised of a plurality of guide rods 176 that extend from the bottom of the control member 170. The control member 170 is therefore guided by the guide rods 176 at the bottom and by the cam pins 182 of the fins 180 at the top. In other instances, the bottom guide can be similar to the top guide described (optionally omitting the cam pins 182).

Still referring to FIG. 2, the jet sub 126 has a tubular body that has an axial flow passage 184 in its interior. The jet sub 126 receives fluid in its interior through the axial flow passage 184. Additionally, the body 150 of the jet sub 126 has one or more radially oriented ports or jet apertures 152 spaced about its circumference. The jet apertures 152 in the jet sub 126 may be replaceable. The jet apertures 152 operate to direct perforating fluid through to the outer casing 132 so as to form perforations 136 in the outer casing 132.

As shown in the current embodiment, the fluid distributor 124 control member 170 is in the closed position, i.e., the control member 170 is substantially sealing against the seat 178 so as to substantially prevent the fluid from flowing into the flow volume 168. As a result, there is no substantial flow out of the fracturing apertures 158 when in the control member 170 is in the closed position. The fluid flows from the top of the fluid distributor 124 to the bottom of the fluid distributor 124 via the axial passage 164 (flow arrow 166). Fluid then flows from the bottom of the fluid distributor 124 to the jet sub 126 (flow arrows 186 and 190). The flow volume 168 that leads to the fracturing apertures 158 is regulated by the poppet 174 portion of the control member 170.

Once perforating and fracturing string 112 is in position, perforating fluid flows down the axial flow passage 164 in the fluid distributor 124 and into the jet sub 126 (flow arrows 166, 186 and 190). The jet sub 126 receives fluid in its interior axial flow passage 184 at high pressure. The jet apertures 152 direct the fluid out into the wellbore 110 (flow arrows 188 and 192) such that the perforating fluid perforates the casing 102, the outer casing 132 of the window sleeve 130, or other wall of the wellbore 110.

Figure 3:
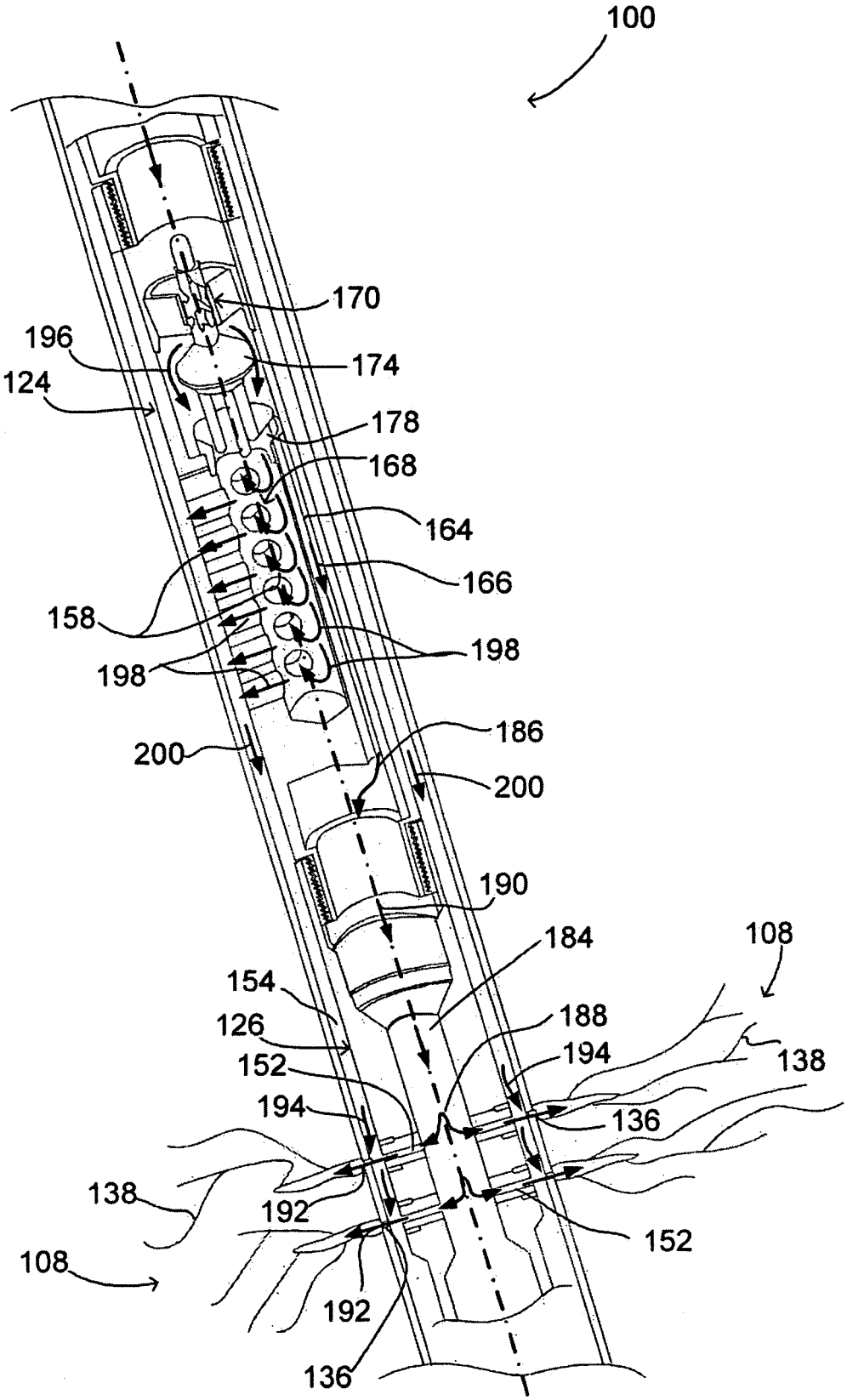
FIG. 3 is a partially-sectioned detail view of the portion of FIG. 2 in another mode of operation.

After the perforating fluid has been introduced through the interior of the supply tube 120 (flow arrow 202) and communicated by the jet sub 126 to perforate the wall of the wellbore 110 as in FIG. 2, the fluid distributor 124 is changed to the open position to perform fracturing operations. Referring now to FIG. 3, the flow of the fluid is reversed for a short while followed by a forward flow of fracturing fluid down the perforating and fracturing string 112. The cycle of reverse flow and forward flow cycles the control member 170 into the next position, i.e., moves poppet 174 off of the seat 178. Moving the poppet 174 off of the seat 178 allows the fracturing fluid to flow into the flow volume 168 and flow out of radial fracturing apertures 158 in the fluid distributor 124. In FIG. 3, the fluid distributor 124 is shown with the control member 170 in the open position.

The formation is fractured 138 by the communication of fracturing fluid into the annulus 154 in the vicinity of the jet sub 126 and the flow of fracturing fluid through the jet apertures 152 in the jet sub 126. The flow arrows 196, 198, 200, 166, 186, 190, 188, 194 and 192 represent the flow paths of fracturing fluid. When the poppet 174 is open, flow in the fluid distributor 124 may go into fluid communication with the flow volume 168 area (flow arrows 196) and into fluid communication with the radial fracturing apertures 158. As fracturing fluid flows down into the flow volume 168 and out of the radial fracturing apertures 158 it flows into fluid communication with the annulus 154 (flow arrows 198 and 200). The fracturing fluid flows down through the axial passage 164 (flow arrow 166) in the fluid distributor 124 and flows (flow arrows 186 and 190) into fluid communication with the interior axial flow passage 184 of the jet sub 126. The fluid in communication with the jet sub 126 flows out (flow arrows 188 and 192) of the jet apertures 152 in the jet sub 126 and is directed through the perforations 136. The flow of fracturing fluid out of the jet sub 126 entrains (flow arrow 194) the fracturing fluid in the annulus 154 in the vicinity of the jet sub 126 into the perforations 136 to fracture 138 earth 116.

The size of the fracturing apertures 158 relative to the size of the axial flow passage 164 is very large. Accordingly, a larger portion of the fracturing fluid exits the perforating and fracturing string 112 through the fracturing apertures 158 than is communicated to the jet sub 126 and out the jet apertures 152. Furthermore, the size of fracturing apertures 158 relative to the size of the axial flow passage 164 is such that the right ratio of flow is achieved to draw the fracturing fluid into the earth 116.

After the perforating and fracturing operations at a given location are complete, the perforating and fracturing string 112 may be moved to align the jet sub 126 with another location for desired perforating and fracturing, or the perforating and fracturing string 112 may be withdrawn to the surface 106. To perforate and fracture at another location along the longitudinal axis of the wellbore, the fluid distributor 124 may be reset to the closed position by reversing flow momentarily, then flowing down again with fluid. Of note, multiple locations can be perforated and fractured on a single trip of the perforating and fracturing string 112 into and out of the wellbore 110.

Figure 4:
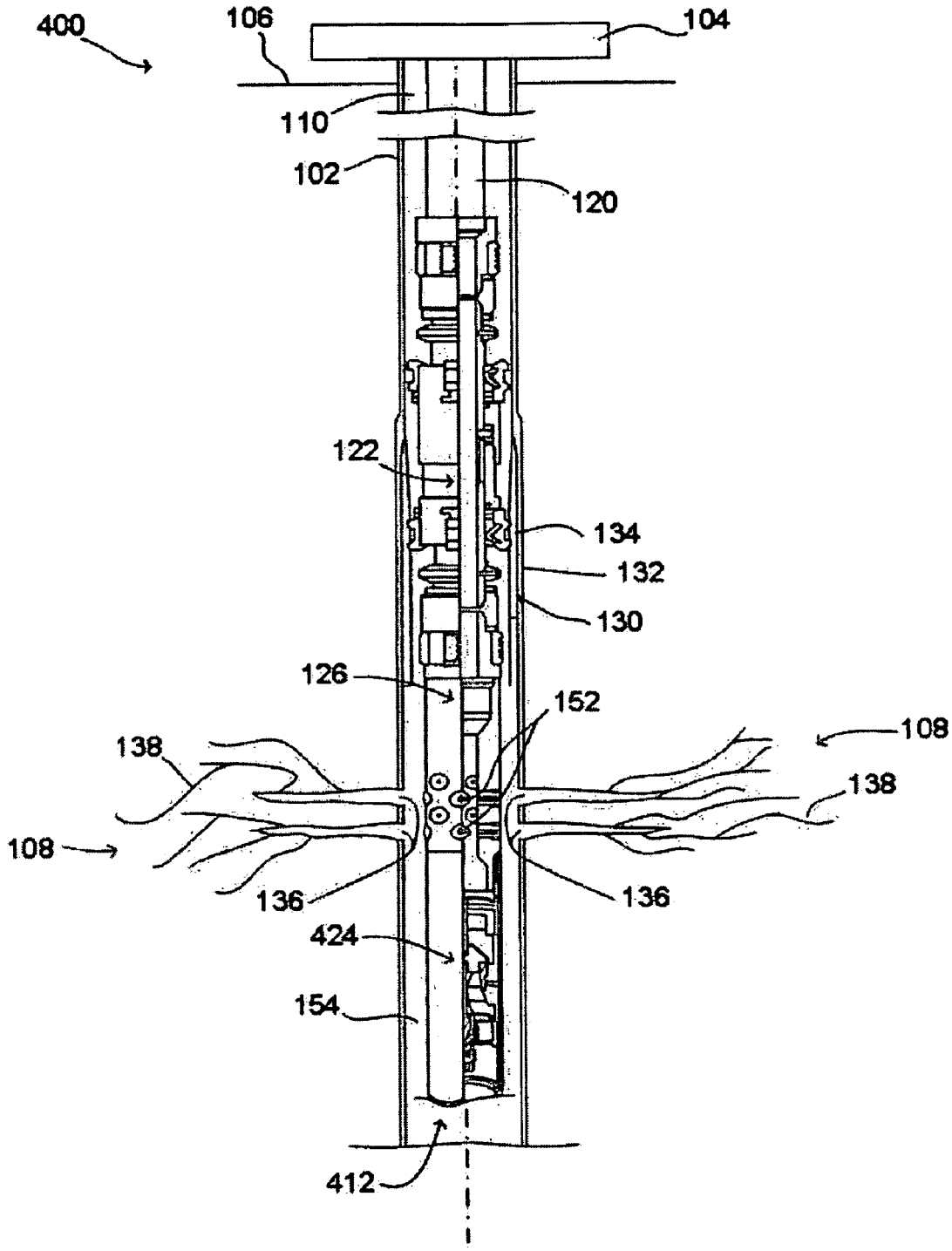
FIG. 4 is a partially-sectioned diagram illustrating another example of a system for perforating and fracturing a subterranean formation.

Referring to FIG. 4, a well 400 is shown with an alternate embodiment of a perforating and fracturing string 412. The perforating and fracturing string 412 is disposed in the wellbore 110 proximal to the formation that is to be perforated and fractured. The method of perforating and fracturing the outer casing 132 and the formation with the current embodiment of the perforating and fracturing string 412 is similar to the method previously described for the embodiment of FIG. 1. However, the operation of the current embodiment of the perforating and fracturing string 412 is different than the operation previously described for the embodiment of FIG. 1.

In this embodiment, the jet sub 126 is upstream of the fluid distributor 424. The top of the jet sub 126 is coupled to the bottom of the sleeve operating tool 122. The bottom of the jet sub 126 is coupled to the top of the fluid distributor 424. The operation of the jet sub 126 and the jet apertures 152 during the perforating and fracturing cycle is similar to the operation previously described in the embodiment of FIG. 1.

Unlike the embodiment of FIG. 1, the fluid distributor 424 does not have any radial fracturing apertures. In this instance, during the fracturing operation, fracturing fluid flows out of the jet apertures 152 in the jet sub 126 and concurrently or simultaneously out the bottom of the perforating and fracturing string 112. The bottom of the perforating and fracturing string 412, i.e., bottom of the fluid distributor 424, is in communication with the wellbore 110 as well as the annulus 154 between the perforating and fracturing string 412 and the outer casing 132. The fracturing fluid flows out of the bottom of the fluid distributor 424 into the annulus 154. As in the fracturing operation in the embodiment of FIG. 1, the fracturing fluid in the annulus 154 is entrained into the perforations 136 and into the earth 116 to form fractures 138.

Figure 5:
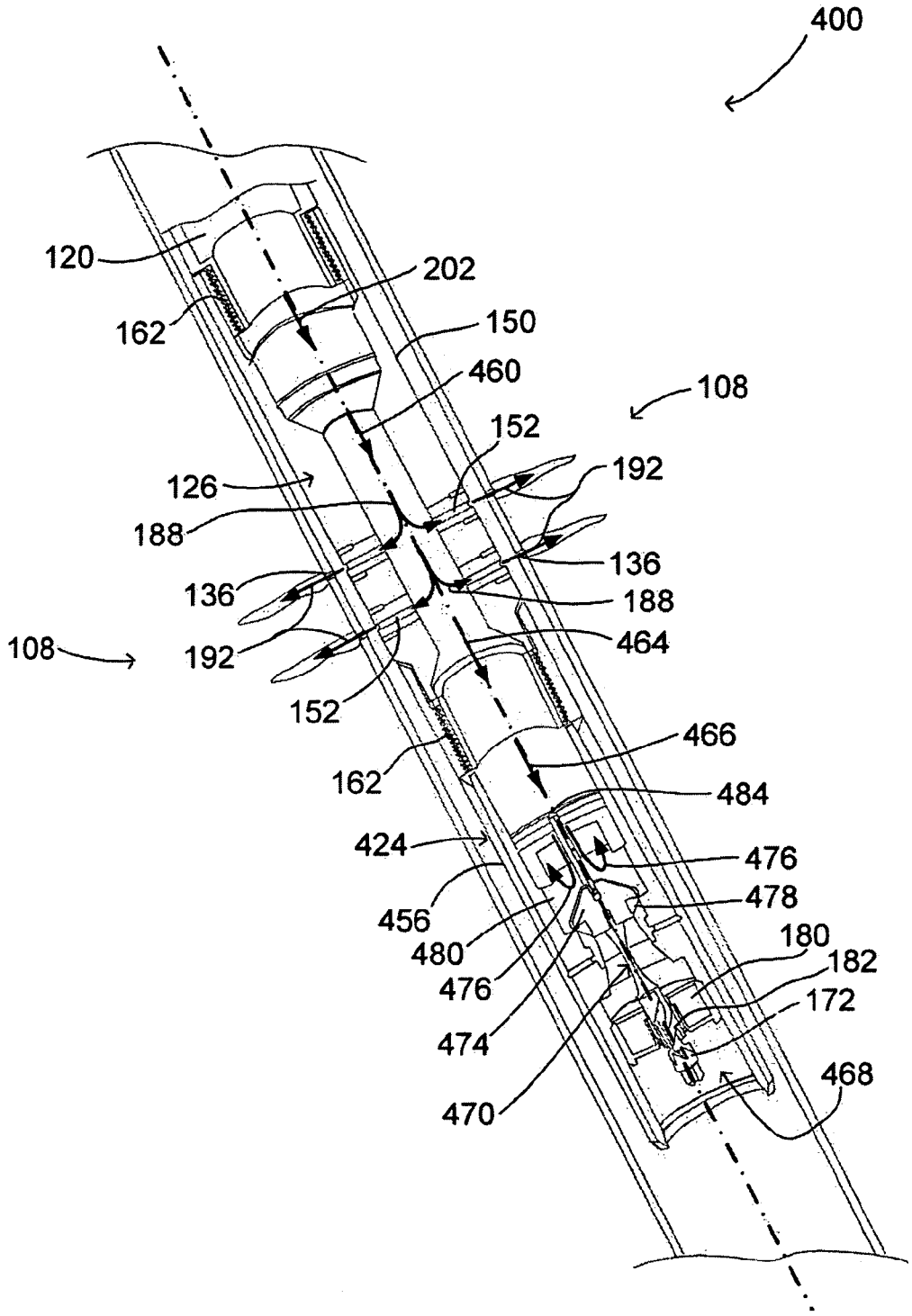
FIG. 5 is a partially-sectioned detail view of a portion of the system of FIG. 4 in one mode of operation.

Referring to FIG. 5, a section of the well 400 and a section of the perforating and fracturing string 412 that includes the jet sub 126 and the fluid distributor 424 is shown. Both the jet sub 126 and the fluid distributor 424 have tubular bodies 150 and 456. As in the embodiment of FIGS. 1-3, the fluid distributor 424 has a valve mechanism, control member 470, in its interior that controls the flow of fluid into the flow volume 468. The control member 470 is located above the flow volume 468. The control member 470 contains a poppet 476 and a cam slot assembly 472. The poppet 474 portion of the control member 470 substantially seals against a seat 478 when in the closed position to block fluid flow into the flow volume 468. The poppet 474 of the control member 470 is displaced from the seat 478 to allow flow therebetween when in the open position, i.e., fluid may flow into the flow volume 468 and out the bottom of the perforating and fracturing string 412.

Still referring to FIG. 5, the fluid distributor 424 in this embodiment uses a top guide and a bottom guide. The top guide is comprised of one or more radially oriented fins 480. The radially oriented fins 480 define a circular hole in the middle of the inside of the fluid distributor 424. The set of radially oriented fins 480 at the top of the fluid distributor defines and acts as a guide for a guide rod 484. Likewise, the bottom guide is comprised of a plurality of radially oriented fins 180. Each of the fins 180 at the bottom of the fluid distributor has a pin, cam pin 182, that rides in a cam slot in the cam slot assembly 172 on the bottom part of the control member 470. The cam slot assembly 172 and cam pins 182 in this embodiment operate in similar way as the ones in FIGS. 1-3 to control operation of the poppet 474. By reversing the fluid flow and then flowing the fluid flow forward, the control member 470 is changed from an open position (with the poppet 474 substantially sealing against the seat 478) to a closed position (with the poppet 474 displaced from the seat 478) or from the closed position to open the open position.

Figure 6:
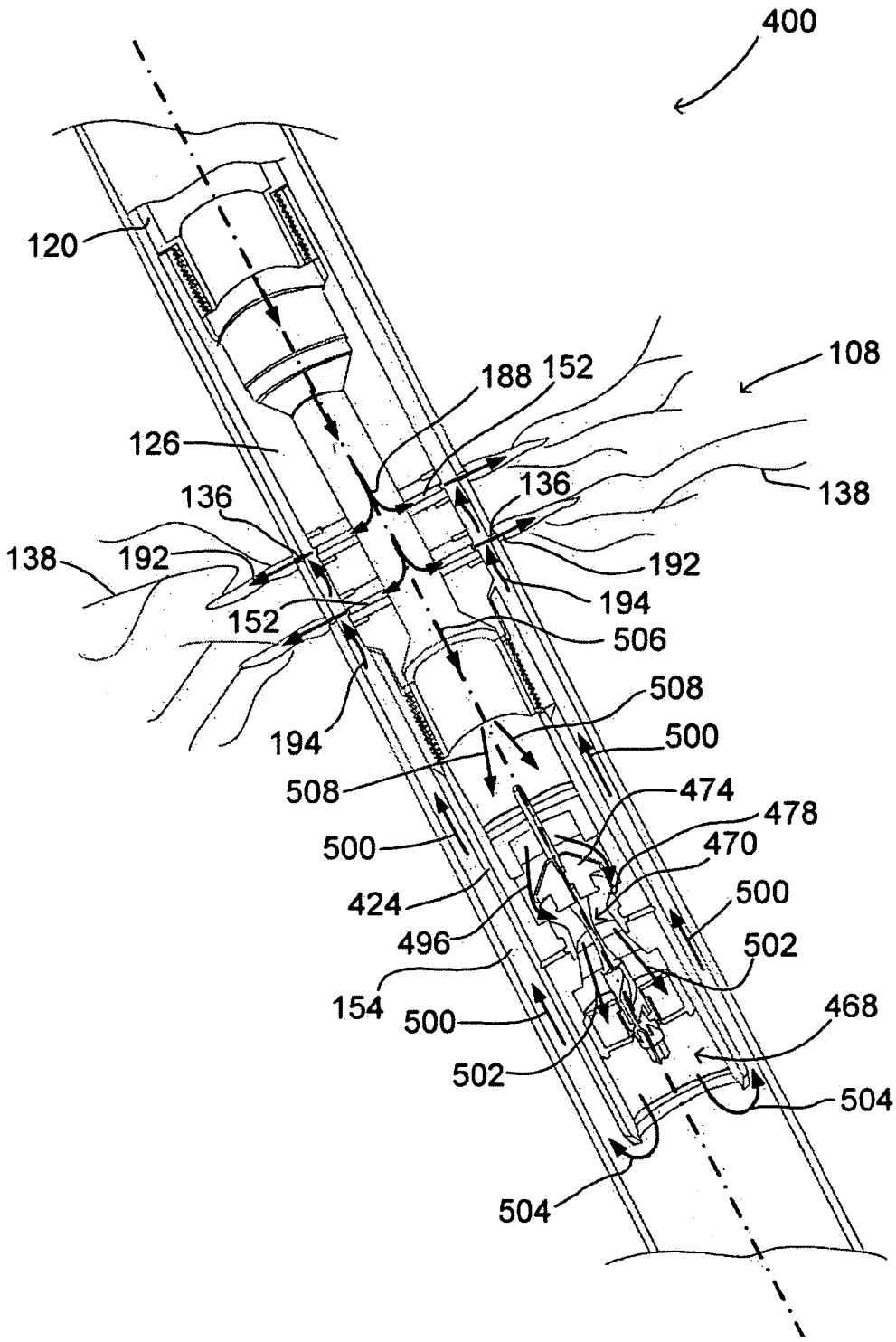
FIG. 6 is a partially-sectioned detail view of the portion of FIG. 5 it in another mode of operation.

The jet sub 126 and fluid distributor 424 in FIG. 6 are configured to perforate the wall of the wellbore 110. The flow of perforating fluid flows down (flow arrows 202, 460, 464, and 466) the perforating and fracturing string 412. The poppet 474 of the control member 470 inside the fluid distributor 424 is seated on and substantially sealing against the seat 478. As a result, the flow of perforating fluid is refused (flow arrows 476) as it communicates with the poppet 474 at the bottom of the fluid distributor 424. The perforating fluid is forced out (flow arrows 955 and 192) the jet apertures 152 in the jet sub 126 to perforate the outer casing 132.

After the perforating fluid has been introduced through the interior of the string (flow arrows 202 and 460) and communicated by the jet sub 126 to perforate the formation (as in FIG. 5), the fracturing fluid is introduced into the annulus 154 in the vicinity of the jet sub 126. Referring now to FIG. 6, the flow of the fluid is reversed for a short while followed by a flow of fracturing fluid down the perforating and fracturing string 412. The cycle of reverse flow and forward flow cycles the control member 470 into the next position, i.e., moves poppet 474 off of the seat 478. Moving the poppet 474 off of the seat 478 allows the fracturing fluid to flow into the flow volume 468 and out of the fluid distributor 424 into the annulus 154. In the embodiment of FIG. 6, the fluid distributor 424 is shown with the control member 470 in the open position.

The formation is fractured 138 by the concurrent or simultaneous communication of fracturing fluid into the annulus 154 in the vicinity of the jet sub 126 and the flow of fracturing fluid through the jet apertures 152 in the jet sub 126. When the poppet 474 is open, flow in the fluid distributor 124 may go into fluid communication with the flow volume 468 area (flow arrows 496 and 502) and into fluid communication with the annulus 154 (via flow arrows 506, 508, 504, and 500). The fracturing fluid in communication with the jet sub 126 flows out (flow arrows 188 and 192) of the jet apertures 152 in the jet sub 126 and is directed through the perforations 136. The flow of fracturing fluid out of the jet apertures in the jet sub 126 creates a low pressure gradient that entrains (flow arrows 494) the fracturing fluid in the annulus 154 in the vicinity of the jet sub 126 into the perforations 136 to fracture 138 formation.

The flow area around the poppet 474 and out the bottom of the perforating and fracturing string 412 is large in comparison to the flow area through the jet apertures 152. Accordingly, a larger portion of the fracturing fluid exits the bottom of the perforating and fracturing string 412 than through the jet apertures 152. Furthermore, the size of the flow area around the poppet 474 relative to the size of the jet apertures 152 is such that the right ratio of flow is achieved to draw the fracturing fluid into the earth 116.

By flowing the fracturing fluid from the surface through the supply tube 120 rather than through the annulus 154, any abrasion or erosion caused by the flow of proppant in the fracturing fluid is confined to the perforating and fracturing string 112. Therefore, components intended to permanently reside with the well 100 (e.g. casing 102, wellhead 104, and other components) are not substantially, if at all, abraded or eroded.

Figure 7:
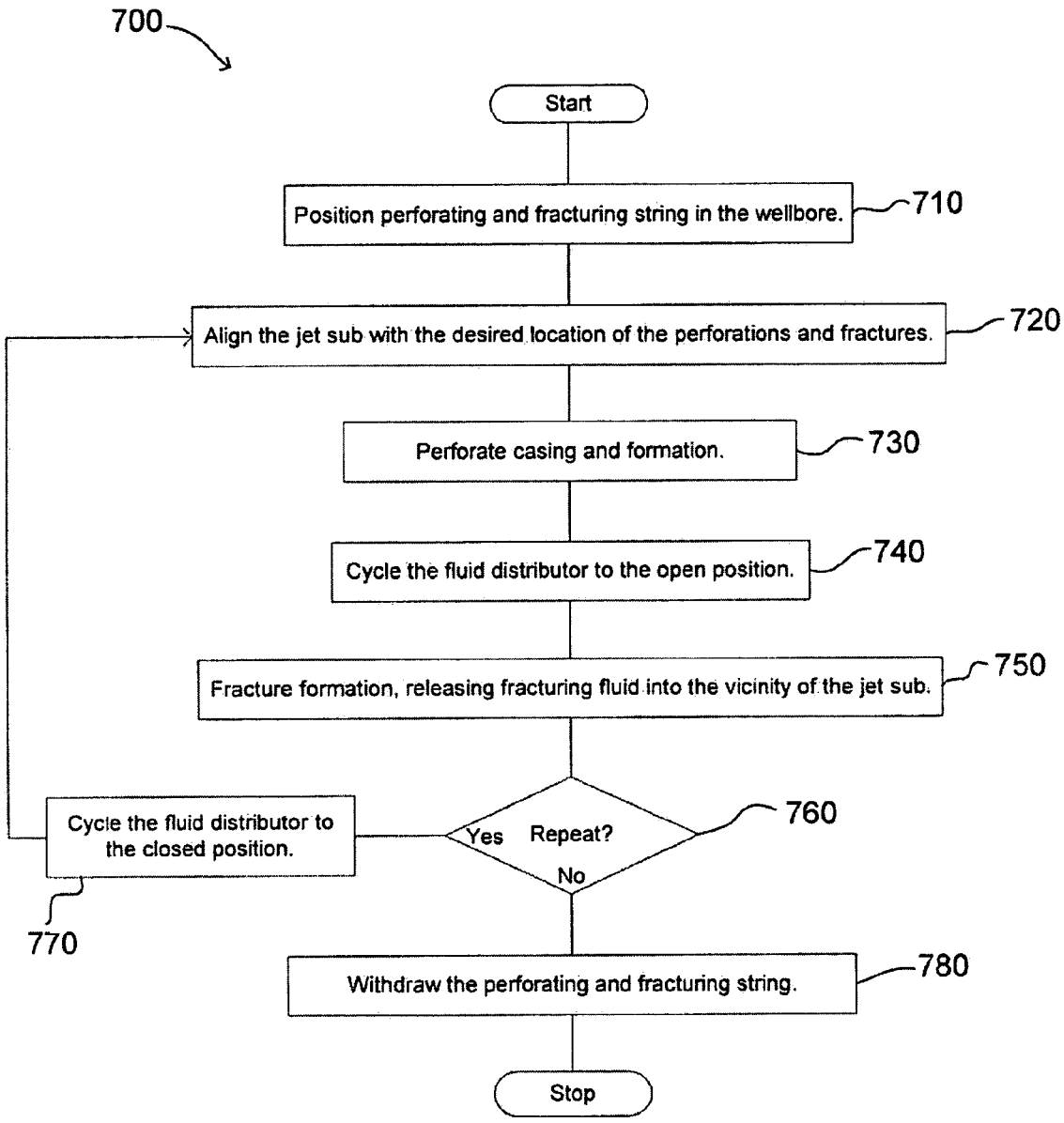
FIG. 7 is a chart illustrating one example of a process for perforating and fracturing a subterranean formation.

Referring to FIG. 7, one exemplary method 700 for perforating and fracturing a wellbore 110 may include deploying a perforating and fracturing string 112 or 412 into the wellbore 110. The method may include positioning 710 the perforating and fracturing string 112 adjacent to the furthest location (i.e., production interval 108) in the wellbore 110 at which perforations 136 and fractures 138 are to be formed. The jet sub 126 may then be aligned 720 proximal to the desired location to be perforated and fractured. Typically, the perforating and fracturing string 112 or 412 is initially deployed in the wellbore with the fluid distributor 124 or 424 in the closed position. If perforating and fracturing string 112 or 412 is deployed with the fluid distributor 124 or 424 in the open position, the flow of fluid in the perforating and fracturing string 112 or 412 may be reverse and forward cycled so as to cycle the fluid distributor 124 or 424 to the closed position. With the fluid distributor 124 or 424 in the closed position, the formation of the production interval 108 may be perforated 730. Once the perforations 136 have been formed in the formation of the production interval 108, the fluid flow in the perforating and fracturing string 112 or 412 may be reverse and forward cycled so as to cycle 740 the position of the fluid distributor 124 or 424 from the closed position to the open position. With the fluid distributor 124 or 424 in the open position, the fracturing fluid may be released into the vicinity of the jet sub 126. The flow of fracturing fluid to both the fluid distributor 124 or 424 and the jet sub 126 may be such that the formation of the production interval 108 may be fractured 750. If the perforating and fracturing operation is to be repeated 760 at another location, the fluid distributor 124 or 424 may be cycled 770 to the closed position and the perforating and fracturing string 112 or 412 may be positioned to another location in the wellbore 110 such that the jet sub 126 may be aligned proximal to the next desired location to be perforated and fractured. Note that the perforating and fracturing string 112 or 412 can remain in the wellbore 110 during both perforating and fracturing operations and over multiple perforating and fracturing operations. If the perforating and fracturing operation will not to be repeated 760, the perforating and fracturing string 112 and 412 may be withdrawn 780 from the wellbore 110.

Figure 8:
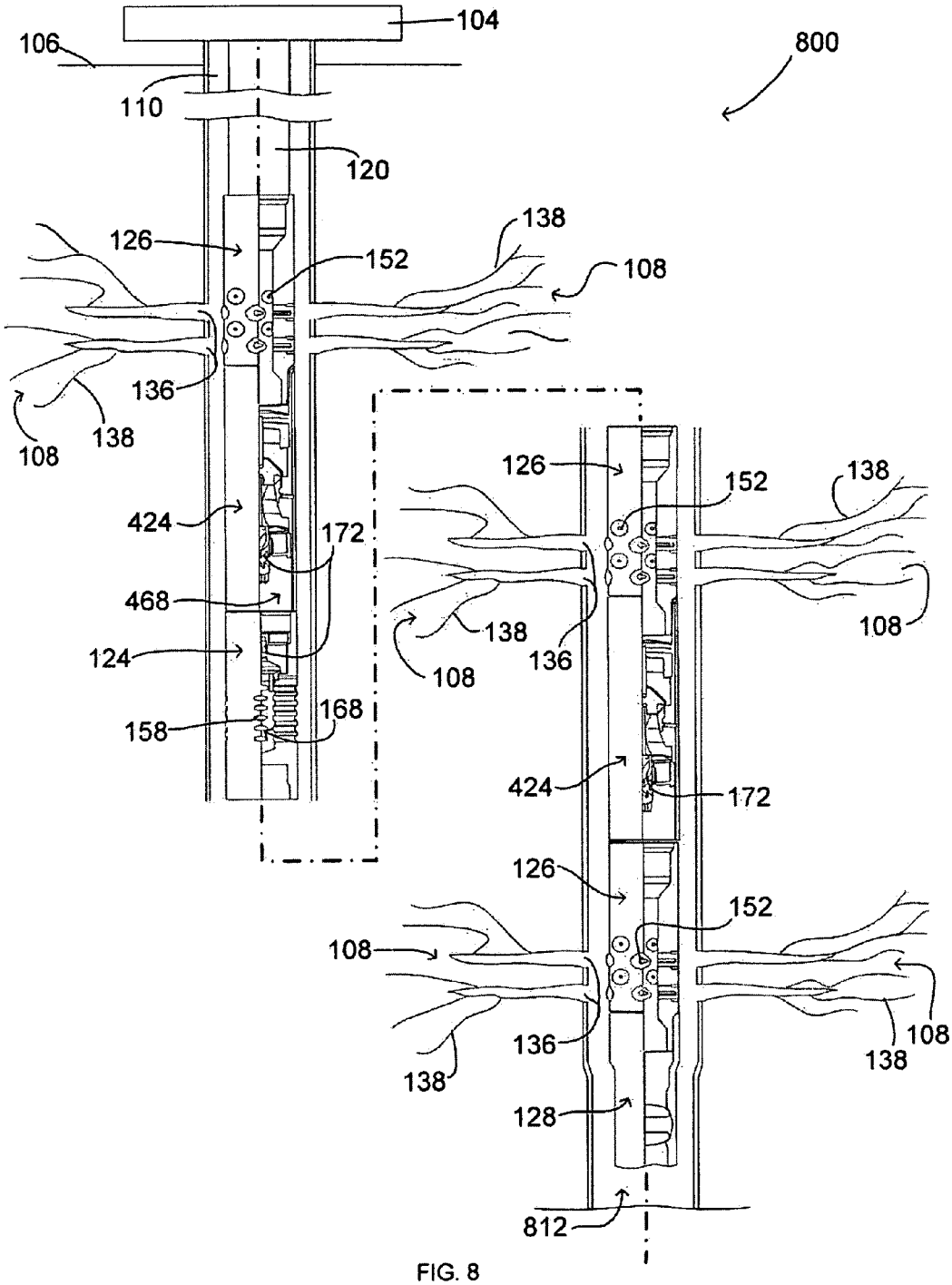
FIG. 8 is a partially-sectioned diagram illustrating another example of a system for perforating and fracturing a subterranean formation.

Referring to FIG. 8, multiple jet subs 126 and fluid distributors 124 and/or fluid distributors 424 may be coupled together in the same perforating and fracturing string to perforate and fracture at multiple locations without moving the string. While there are many possible different configurations of jet subs 126 and fluid distributors 124 and/or fluid distributors within the scope of the invention, FIG. 8 shows a well 800 with one illustrative embodiment of a perforating and fracturing string 812 including three jet subs 126, one of the first illustrative fluid distributors 124, two of the second illustrative fluid distributors 424, and one of the illustrative valves 128. The supply tubing 120 connects to the first jet sub 126. The first jet sub 126 connects to the first fluid distributor 424. As discussed above, fluid distributors 424 omit the radial fluid apertures 158. The first fluid distributor 424 connects to the second fluid distributor 124. As discussed above, the second fluid distributor 124 includes radial fluid apertures 158. The second fluid distributor 124 connects to the second jet sub 126. The second jet sub connects to the third fluid distributor 424. The third fluid distributor 424 connects to the third jet sub 126 which in turn connects to the valve 128. In other instances, the valve 128 may be omitted, and the end of third jet sub 126 may be blind or the perforating and fracturing string 812 may be otherwise blind. Other variations of the illustrative fracturing string 812 are possible (including fewer or more jet subs 126, fluid distributors 124 and fluid distributors 424) and are to be considered as being within the scope of the disclosure.

The perforating and fracturing operation using the illustrative perforating and fracturing string 812 begins with the first fluid distributor 424 in the perforating and fracturing string 812 in the closed position so that the flow of perforating fluid may not flow axially into the flow volume 468 of the first fluid distributor 124. The first jet sub 126 is aligned with the location to be perforated. Perforating fluid flows down through the supply tubing 120 to the first jet sub 126. The fluid flows out of the jet apertures 152 first jet sub 126 and perforates the wall of the wellbore 110 at the first location.

The flow of fluid in the perforating and fracturing string 812 is reverse and forward cycled (flow cycle #1). The reverse and forward cycle of the fluid flow cycles the position of the first fluid distributor 424 to the open position so as to allow axial flow through the flow volume 468. The second fluid distributor 124 is already positioned, when the perforating and fracturing string 812 is initially run-in to the wellbore 110, with the fracturing apertures 158 and the flow volume 168 open. The flow of fracturing fluid flows through the first jet sub 126, the first fluid distributor 424, and flows into the flow volume 168 and out of the radial fracturing apertures 158 in the second fluid distributor 124. Some fluid flows out of fracturing apertures 158 in the second jet sub 126. However since there are no perforations 136 in the area by the second jet sub 126, the fluid exiting the second jet sub 126 remains in the annulus. Additionally, the pressure of the fluid flowing out of the fracturing apertures 158 of the second jet sub 126 is low enough that the second jet sub 126 does not perforate the wellbore 110. In this instance, the third fluid distributor 424 is closed. Therefore, the third fluid distributor 424 does not allow any axial flow through the fracturing apertures 158 in the third jet sub 126. The fluid flow out of the first jet sub 126 creates a low pressure zone that draws the fluid that is coming out of the second fluid distributor 124 up to the perforations 136 formed at the first location. The fluid flows into the formation of the production interval 108 and fractures the formation of the production interval 108.

The flow of fluid in the perforating and fracturing string 812 is once again reverse and forward cycled (flow cycle #2). The cam slot 172 of the first fluid distributor 424 is configured with multiple open positions, so that the first fluid distributor 424 remains in the open position for five consecutive flow cycles. Thus, the first fluid distributor 424 remains in the open position through flow cycle #2. The second fluid distributor 124 cycles to the closed position such that the fluid flow through the volume 168 and out of the fracturing apertures 158 is closed off and the fluid only flows through the axial flow passage 164. The third fluid distributor 424 is in the closed position. The flow of perforating fluid down through the supply tubing 120 flows out of the jet apertures 152 of the second jet sub 126 and perforates the second formation of the production interval 108. Some of the fluid flows out the first jet sub 126.

The flow of fluid in the perforating and fracturing string 812 is once again reverse and forward cycled (flow cycle #3). The first fluid distributor 424 stays in the open position. The second fluid distributor 124 cycles to the open position such that the second fluid distributor 124 allows the fluid to flow into the flow volume 168 and flow radially out of the fracturing apertures 158. The cam slot of the third fluid distributor 424 is configured to remain closed during three cycles and remain open during two cycles. Thus, the third fluid distributor 424 remains in the closed position. The flow of fracturing fluid down the supply tubing 120 flows out of the first jet sub 126, out of the second jet sub 126, and out of the second fluid distributor 124. Although, the first jet sub jet sub 126 draws a portion of the fracturing fluid into the formation about the first location, the second jet sub 126 because it is closest to the second fluid distributor 124 and the second set of perforations draws the majority of the fracturing fluid into the second set of perforations to fracture the formation of the production interval 108. The flow of fracturing fluid is refused against the third fluid distributor 424 because the third fluid distributor 424 is closed.

The flow of fluid in the perforating and fracturing string 812 is once again reverse and forward cycled (flow cycle #4). The first fluid distributor 424 once again remains in the open position. The second fluid distributor 124 cycles to the closed position such that the second fluid distributor 124 allows axial flow but not radial flow out of the fracturing apertures 158. The third fluid distributor 424 cycles to the open position to allow for the fluid to flow into the flow volume 468. The fluid flow from the flow volume 468 of the third fluid distributor flows into the third jet sub 126. The perforating fluid is flowed down the supply tubing 120. The fluid flowing into the third jet sub 126 flows radially out of the jet apertures 152 to perforate the wall of the wellbore 110 at a third location. Some of perforating fluid flows out of the first jet sub 126 and the second jet sub 126.

The flow of fluid in the perforating and fracturing string 812 is once again reverse and forward cycled (flow cycle #5). The first fluid distributor 424 once again remains open. The second fluid distributor 124 cycles to the open position such that the fluid flows into the flow volume 168, radially out of the fracturing apertures 158, and into the formation. The third fluid distributor 424 remains in the open position. The fracturing fluid flows down the supply tubing 120. Part of the flow of fracturing fluid goes out the second fluid distributor 124, part flows out of the first jet sub 126, part flows out of the second jet sub 126, and part flows out of the third jet sub 126. The third jet sub 126 draws most of the fracturing fluid into the formation of the production interval 108 fracturing the formation of the production interval 108 about the third location. Thereafter, the perforating and fracturing string 812 can be withdrawn from the wellbore 110, or may be reset and operated to perforate and fracture in other locations within the wellbore 110 without withdrawing the perforating and fracturing string 812 from the wellbore 110.

Figure 9:
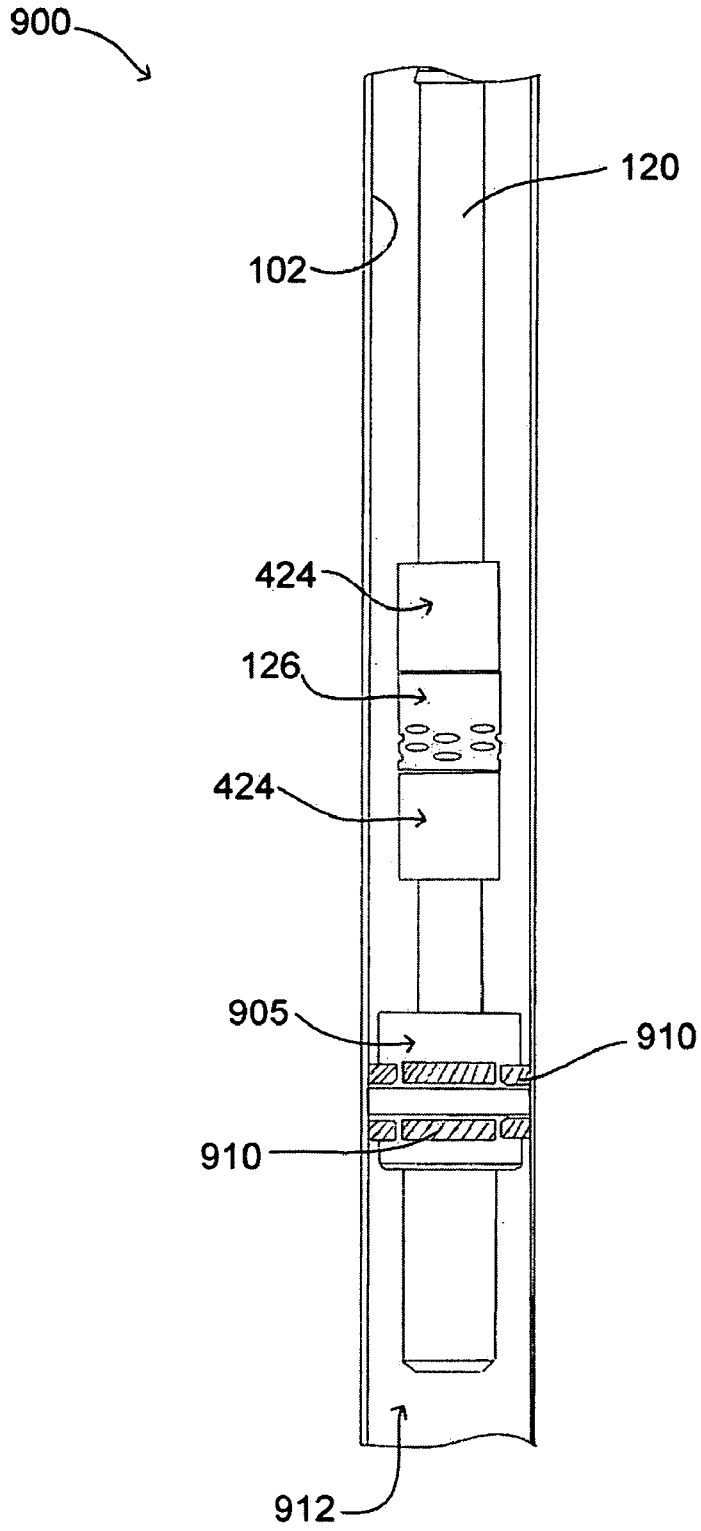

Referring to FIG. 9, a section of a well 900 is shown with fourth illustrative embodiment of a perforating and fracturing string 912 disposed in the wellbore 110. In this fourth illustrative embodiment, packers are used together with a jet sub 126 and fluid distributor 424. The supply tubing 120, two fluid distributors 424, a jet sub 126, and a sump packer 905 are coupled to a perforating and fracturing string 912. In operation, the perforating and fracturing string 912 is run into the wellbore. The sump packer 905 is a type that may be released from the perforating and fracturing string 912 and may be left in position in the wellbore 110 after the perforating and fracturing string 912 has been moved. The sump packer 905 has seals 910 that are actuable to substantially seal against the casing 102 wall of the wellbore 110. The seals 910 on the sump packer 905 are set and the sump packer 905 is released from the perforating and fracturing string 912. The perforating and fracturing string 912 is lifted up from the sump packer 905 until the jet sub 126 is aligned with the location at which the perforations 136 are desired. The bottom fluid distributor 424 is cycled into the closed position and the top fluid distributor 424 is in the open position. The jet sub 126 is operated to perforate the casing 102 wall of the wellbore 110.

The formation of the production interval 108 may optionally be fractured by cycling the bottom fluid distributor 424 to the open position, and flowing fracturing fluid through the bottom of the perforating and fracturing string 912 while concurrently out of the jet sub 126. As discussed above, flow out of the jet sub 126 creates a pressure gradient in the perforations 136 that draws the fracturing fluid into the formation of the production interval 108 to fracture the formation. Packers are not needed for fracturing the formation of the production interval 108 in this manner. Upon completing the fracturing, the perforating and fracturing string 912 is withdrawn from the wellbore 110.

Figure 10:
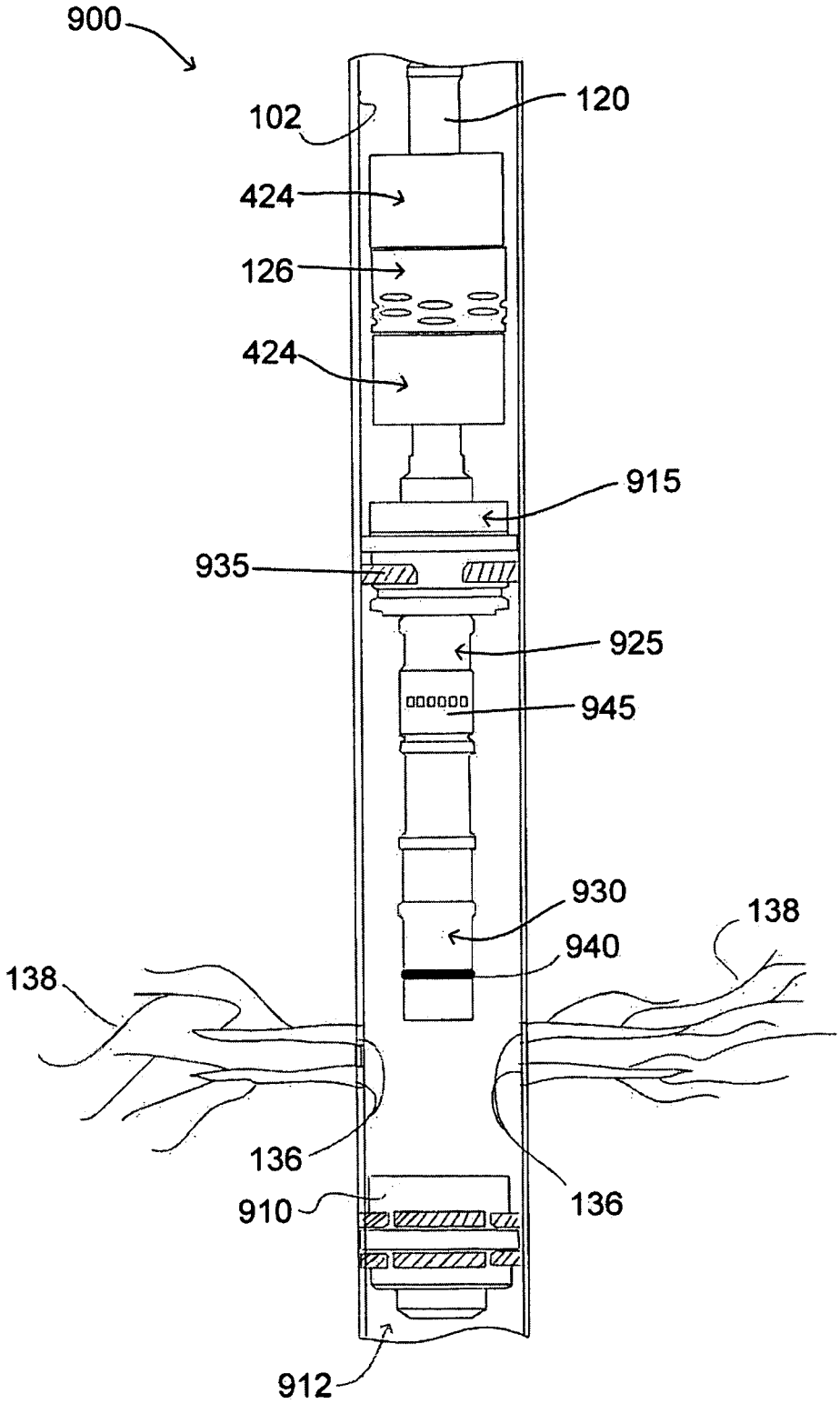

Referring to FIG. 10, the formation of the production interval 108 can alternately be fractured using packers. To this end, the perforating and fracturing string 912 is withdrawn from the wellbore 110. A releasable packer 915, a tubing window system 925, and a stab 930 are coupled to the bottom fluid distributor of the perforating and fracturing string 912. Once again the perforating and fracturing string 912 has a top fluid distributor 424, a jet sub 126, a bottom fluid distributor 424 and a length of supply tubing 120. The perforating and fracturing string 912 reenters the wellbore 110. The perforating and fracturing string 912 is positioned such that the end of the stab 930 is aligned proximal to the perforations 136 formed in FIG. 9. The top and bottom fluid distributors 424 are cycled so as to be in the open position prior to the perforating and fracturing string 912 reentering the wellbore 110. The packer 915 has a seal 935 that is actuable to substantially seal against the casing 102 wall of the wellbore 110. The releasable packer 915 is set, fracturing fluid flows down the center of the supply tubing 120. The fracturing fluid flows into the area defined between the sump packer 905 and the packer 915. The perforating and fracturing string 912 releases fracturing fluid into the perforation 136 area at a high enough pressure that it will flow into the perforations 136 and fracture 138 the formation of the production interval 108.

The perforating and fracturing string 912 has a sliding window sleeve 945 on the tubing window system 925 that leads down to the stab 930. The stab 930 has one or more seals 940 circumferentially around the exterior of the stab 930. After fracturing, the releasable packer 915 is released from the casing 102 wall and the stab 930 is stabbed into the sump packer 905. The seals 940 on stab 930 substantially seal and make the connection to the sump packer 905. The packer 915 is actuated to substantially seal with the casing 102.

The sliding window sleeve 945 is on the tubing window system 945 between the stab 930 and the releasable packer 915. The tubing of the window system 925 has radial holes oriented circumferentially around the tubing window system 925. An operating tool operates the sliding window sleeve 945 so as to slide the sliding window sleeve 945 between an open and a closed position. In the closed position the holes in the tubing window system 925 and in the sliding window sleeve 945 do not line up, and substantially prevent flow between the interior of the tubing window system 925 and the formation of the production interval 108. Accordingly, with the tubing window system 925 closed, the interval between the packer 915 and the sump packer 905 is substantially isolated. In the open position, the holes in the tubing window system 925 and in the sliding window sleeve 945 line up and allow fluid to flow through that portion of the perforating and fracturing string 912.

Figure 11:
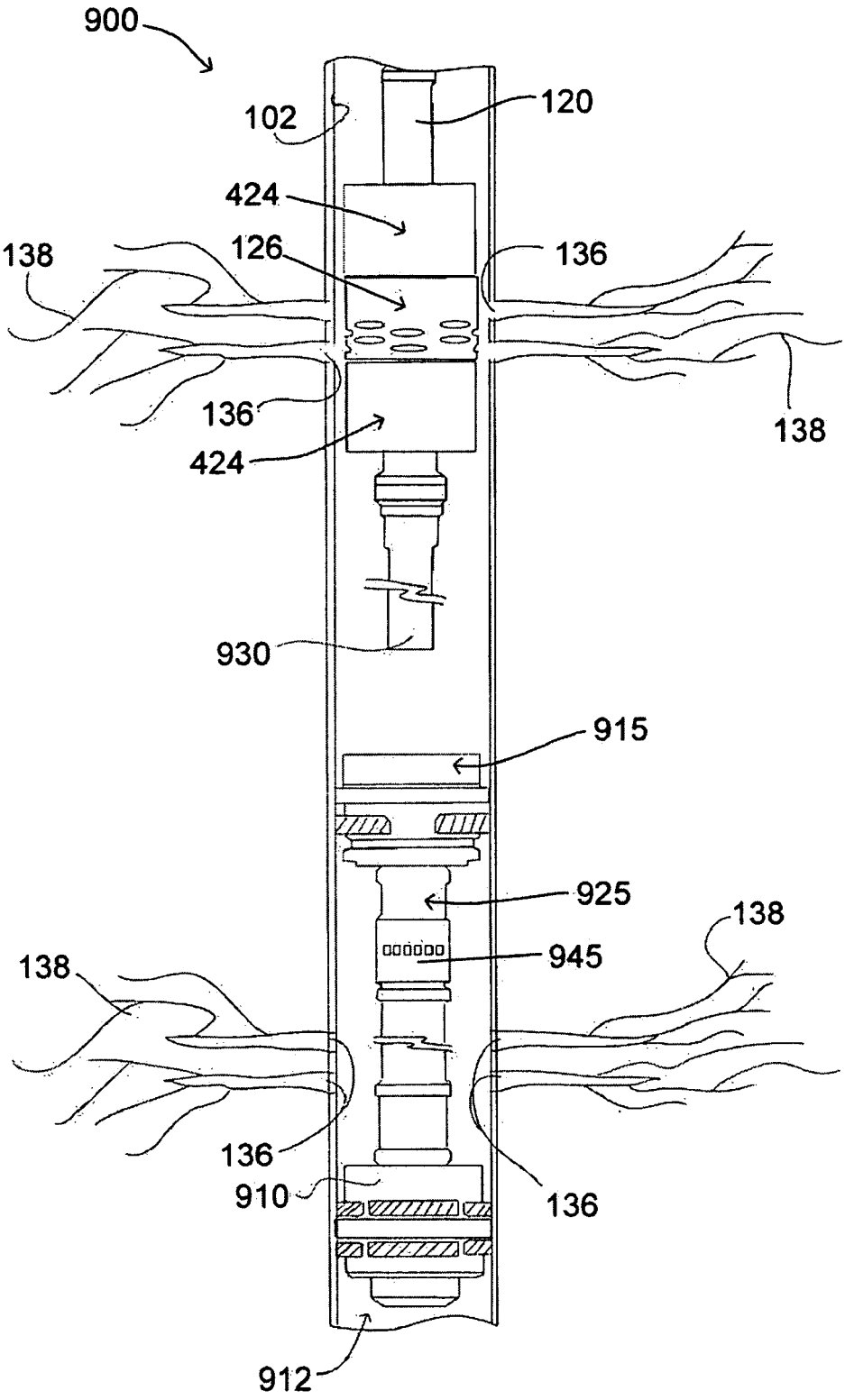

Referring to FIG. 11, the portion of the perforating and fracturing string 912 uphole from the releasable packer 915 is released. The portion of the perforating and fracturing string 912 that is released has the two fluid distributors 424 and the jet sub 126. After the perforating and fracturing string 912 is released the perforating and fracturing string 912 is moved up the wellbore 110 so as to align proximal to the area where the next set of perforations and fractures are to be formed. The perforating operation described above is repeated.

The formation of the production interval 108 may be fractured without using packers as described above, and the perforating and fracturing string 912 with the two fluid distributors 424 and the jet sub 126 may then removed from the wellbore 110. Alternately, the formation of the production interval 108 may be fractured using packers. To this end, after the perforating and fracturing string 912 has been withdrawn from the wellbore 110, the perforating and fracturing is once again set up with a configuration that includes another releasable packer 915, another tubing window system 925, and another stab 930. The perforating and fracturing string 912 is returned into the wellbore 110 with a configuration like that of FIG. 10, including a two fluid distributors 424, a jet sub 126, a releasable packer 915, a tubing window system 925, and a stab 930. The stab 930 is positioned proximate the perforations 136 and the packer 915 is actuated to substantially seal with the casing 102. Fracturing fluid is flowed down the supply tubing 120. The fracturing fluid flows into the area defined by between the first packer 915 and the packer 915 that was just set. The perforating and fracturing string 912 releases fracturing fluid into the perforations 136 area at a high enough pressure that it will flow into the perforations 136 and fracture 138 the formation of the production interval 108. The stab 930 is then stabbed into the back of the first releasable packer 915 and the portion of the perforating and fracturing string 912 uphole from the second releasable packer 915 is released. Once again, the portion of the perforating and fracturing string 912 that is released is the portion that has the two fluid distributors 424 and the jet sub 126. The perforating and fracturing string is then moved further up the wellbore 110 to the next to the spot to be perforated and fractured.

The perforating and fracturing operations described above maybe repeated multiple times to perforate and fracture the formation of the production interval 108 at multiple locations as desired.

Figure 12:
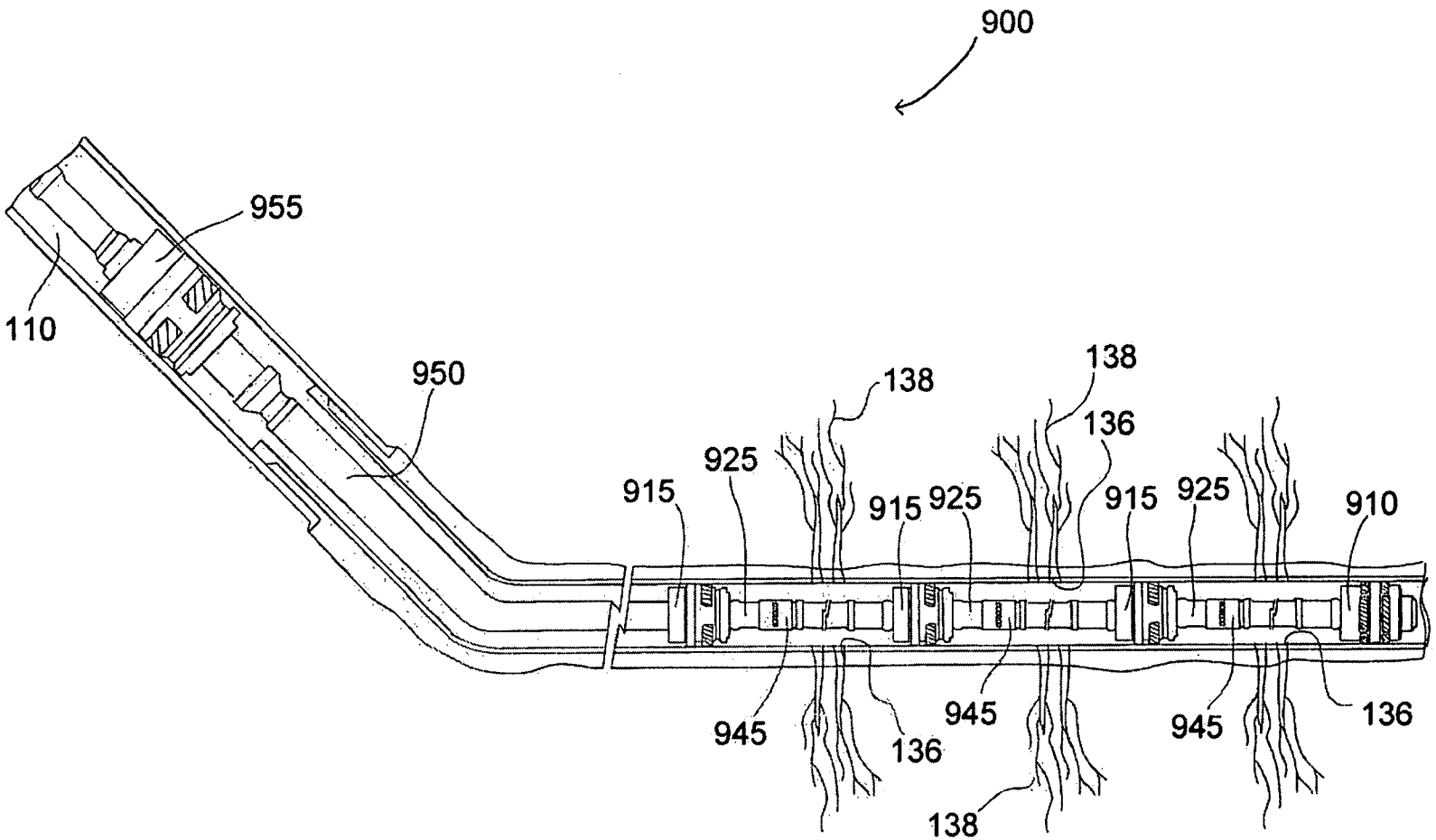

Referring to FIG. 12, once the last releasable packer 915 has been set, and the perforating and fracturing string 912 removed from the wellbore 900, a string of production tubing 950 with a production packer 955 and a stab 930 on the end may be lowered into the wellbore 110 and stabbed into the upper most releasable packer 915. The sliding sleeves may then be selectively opened and closed to allow selective access to the perforations 136 and the fractures 138 defined in the intervals between the seals 910 and 915. A window sleeve operating tool may be run down the perforating and fracturing string 912 to selectively open the window sleeve 945 in the tubing window systems 925 to produce from the different production intervals.

A number of implementations have been described, and several others have been mentioned or suggested. Furthermore, a variety of additions, deletions, modifications, and/or substitutions to these implementations will be readily suggested to those skilled in the art while still achieving subterranean formation fracturing. Accordingly, the invention should be measured be the following claims, which may encompass one or more of the implementations.

What is claimed is:

1. A method of perforating and fracturing a subterranean formation, comprising:

receiving a fluid for perforating in a downhole tool in a wellbore;

supplying the fluid for perforating from the downhole tool to an aperture of the downhole tool, wherein the aperture is operable to direct the fluid for perforating toward the wall of the wellbore to perforate the wall of the wellbore;

receiving a fluid for fracturing in the downhole tool in the wellbore;

supplying a first portion of the fluid for fracturing from the downhole tool to an annulus between the downhole tool and the wall of the wellbore proximate the downhole tool; and supplying a second portion of the fluid for fracturing to an aperture operable to direct the second portion toward the wall of the wellbore such that at least part of the first portion in the annulus flows into the subterranean formation.

2. The method of claim 1 wherein the fluid for fracturing comprises a proppant.

3. The method of claim 1 wherein the wall of the wellbore comprises a casing.

4. The method of claim 1 wherein the first portion of the fluid for fracturing comprises over eighty percent of the fluid for fracturing.

5. The method of claim 1 wherein supplying the first portion of the fluid for fracturing to the annulus between the downhole tool and the wall of the well comprises activating a fluid distributor of the downhole tool.

6. The method of claim 1 wherein the aperture is operable to cause at least part of the first portion of the fluid for fracturing in the annulus to flow into the perforation by creating a low pressure region proximate the perforation with the second portion of the fluid for fracturing.

7. The method of claim 1 further comprising:

adjusting the location of the downhole tool relative to the longitudinal axis of the wellbore to a second location while keeping at least a portion of the downhole tool in the wellbore; and repeating the receiving and supplying operations to perforate and fracture the subterranean formation at the second location.

8. The method of claim 1 further comprising packing the wellbore on a first side of a perforation in the wall of the wellbore and on a second side of the perforation before supplying the formation fracturing fluid.

9. The method of claim 1 wherein the fluid for fracturing comprises the fluid for perforating.

10. A system for fracturing a subterranean formation, comprising:

a formation fracturing apparatus comprising:

an intake operable to receive a formation fracturing fluid while in a wellbore; and a fluid distributor operable to:

supply a first portion of the formation fracturing fluid to an annulus between the formation fracturing apparatus and a wall of the wellbore proximate the formation fracturing apparatus; and supply a second portion of the formation fracturing fluid to an aperture of the system, wherein the aperture is operable to direct the second portion toward the wall of the wellbore such that the second portion causes at least part of the first portion in the annulus to flow into the subterranean formation and wherein the aperture is operable to cause at least part of the first portion of the formation fracturing fluid in the annulus to flow into a perforation of the wellbore by creating a low pressure region proximate the perforation with the second portion of the formation fracturing fluid.

11. The system of claim 10 wherein the intake is configured and arranged to couple to a work string.

12. The system of claim 10 wherein:

the intake is further operable to receive a perforating fluid;

the fluid distributor is further operable to supply the perforating fluid to the aperture without supplying a substantial portion of the perforating fluid to the annulus; and the aperture is further operable to form the perforation by directing the perforating fluid toward the wall of the wellbore.

13. The system of claim 10 wherein:

the location of the formation fracturing apparatus may be adjusted relative to the longitudinal axis of the wellbore to a second location while keeping the formation fracturing apparatus in the wellbore; and a formation fracturing fluid may again be received and distributed, to cause at least part of a first portion of the formation fracturing fluid in the annulus to flow into the subterranean formation at a second location.

14. The system of claim 10 further comprising:

a packer operable to be set on a first side of a perforation in the wall of the wellbore before supplying the formation fracturing fluid; and a packer operable to be set on a second side of the perforation before supplying the formation fracturing fluid.

15. A method comprising:

receiving fluid for perforating in a downhole tool through a tubing string, wherein the downhole tool resides in a wellbore;

perforating, with the fluid for perforating through a plurality of apertures, a wall of the wellbore proximate the downhole tool, the plurality of apertures used in perforating defining first apertures;

receiving fluid for fracturing in the downhole tool through the tubing string;

opening a flowpath to at least one second aperture; and fracturing, with the fluid for fracturing through the at least one second aperture of the downhole tool distinct from the first apertures, a subterranean formation proximate the downhole tool, wherein the operations of receiving a fluid for perforating, perforating, receiving a fluid for fracturing, and fracturing are performed while keeping at least a portion of the downhole tool in the wellbore.

16. The method of claim 15 further comprising:

adjusting the location of the downhole tool relative to the longitudinal axis of the wellbore while keeping at least a portion of the downhole tool in the wellbore; and fracturing, with the fracturing fluid, the subterranean formation at a second location.

17. The method of claim 15 wherein the fluid for fracturing comprises proppant.

18. The method of claim 15 wherein fracturing the subterranean formation comprises:

supplying a first portion of the fracturing fluid into an annulus between the downhole tool and the wall of the wellbore; and supplying a second portion of the fracturing fluid to an aperture operable to direct the second portion toward the wall of the wellbore such that at least part of the first portion in the annulus flows into the subterranean formation.

* * * * *